United States Patent [19]

Synofzik et al.

[11] Patent Number: 4,860,660

[45] Date of Patent: Aug. 29, 1989

[54] PROJECTILE

[75] Inventors: Reinhard Synofzik, Jüchen; Karl-Friedrich Doherr, Braunschweig; Dieter Münscher, Braunschweig; Christos Saliaris, Braunschweig, all of Fed. Rep. of Germany

[73] Assignee: Rheinmetall GmbH, Düsseldorf, Fed. Rep. of Germany

[21] Appl. No.: 135,510

[22] Filed: Dec. 16, 1987

[30] Foreign Application Priority Data

Dec. 18, 1986 [DE] Fed. Rep. of Germany ..... 3643294

[51] Int. Cl.[4] ..... F42B 13/32

[52] U.S. Cl. ..... 102/501; 102/386; 102/489; 244/3.3

[58] Field of Search ..... 102/340, 342, 351, 357, 102/386, 387, 388, 393, 400, 354, 476, 501, 517, 489; 244/113, 138, 142, 3.1, 3.24, 3.27, 3.3

[56] References Cited

U.S. PATENT DOCUMENTS

| | | | |
|---|---|---|---|
| 3,047,259 | 7/1962 | Tatnall et al. | 102/386 |
| 3,114,315 | 12/1963 | Trump | 102/388 |
| 3,228,634 | 1/1966 | Chakoian et al. | 102/388 |
| 3,350,040 | 10/1967 | Sims et al. | 244/113 |
| 3,710,715 | 1/1973 | Hoofnagle . | |
| 4,005,655 | 2/1977 | Kleinschmidt et al. | 102/386 |
| 4,215,836 | 8/1980 | Zacharin | 102/386 |
| 4,565,341 | 6/1986 | Zacharin | 102/386 |
| 4,649,826 | 3/1987 | Stevino | 102/340 |
| 4,726,543 | 2/1988 | Stessen | 102/386 |

FOREIGN PATENT DOCUMENTS

| | | | |
|---|---|---|---|
| 3127071 | 6/1985 | Fed. Rep. of Germany . | |
| 3608107 | 10/1987 | Fed. Rep. of Germany . | |
| 2187825 | 9/1987 | United Kingdom | 102/387 |

*Primary Examiner*—Harold J. Tudor
*Attorney, Agent, or Firm*—Spencer & Frank

[57] ABSTRACT

A projectile comprising a projectile body having a rear end; and a deceleration element composed of a sheet of material at the rear end, the deceleration element having an edge region and being deployable from a folded condition to an expanded condition with the aid of rotation of the projectile, the deceleration element, when in the expanded condition, having the general form of a disk with a periphery defined by the edge region and being effective for decelerating the projectile, and wherein the deceleration element is constructed such that the edge region has a higher mass density than the remainder thereof.

13 Claims, 3 Drawing Sheets

PROJECTILE

BACKGROUND OF THE INVENTION

1. Field of the Invention

The present invention relates to a projectile having a deceleration element disposed at its rear end so as to reduce its velocity. This deceleration element unfolds during the projectile's flight and is composed of a woven fabric or plastic sheeting.

2. Discussion of the Prior Art

German Patent No. 3,127,071 discloses a projectile with a deceleration element. The deceleration element disclosed is provided to reduce velocity, as well as stabilize the projectile and has sails which unfold and are disposed between inflatable hoses. During flight, the hose-type arms are blown up by a gas generator and are arranged so that the blowing action enables the arms to be pivoted against the direction of flight. This further dampens the impact of the projectile on the ground. This dampening of the impact is particularly necessary for droppable mines.

The known deceleration elements have the drawback that they are expensive because they must have their own gas generator. Moreover, the rigidity of the hose-type arms is not of the type required for spin stabilized projectiles.

Finally, the prior art deceleration element takes up a relatively large amount of space in its folded state, particularly in view of the need to accommodate the hose-type arms.

SUMMARY OF THE INVENTION

It is, therefore, an object of the present invention to have a projectile with a deceleration element that takes up as little space as possible in the projectile.

It is a further object of the invention to have a spin stabilized projectile with a deceleration element that is simple and stable in its construction and reduces velocity, as well as spin.

The above and other objects are accomplished by the invention in which a projectile comprises a projectile body having a rear end; and a deceleration element composed of a sheet of material at the rear end, the deceleration element having an edge region and being deployable from a folded condition to an expanded condition with the aid of rotation of the projectile, the deceleration element, when in the expanded condition, having the general form of a disk with a periphery defined by the edge region and being effective for decelerating the projectile, and wherein the deceleration element is constructed such that the edge region has a higher mass density than the remainder thereof.

A significant idea of the invention is to reduce velocity and spin of the submunition bodies by means of a brake disk made of a woven fabric which has additional masses disposed at the edge. These additional masses may be in the form of an edge reinforcement. With this structure the rotation of the projectile causes the larger masses in the edge region of the woven brake disks to initially be propelled outwardly so that the brake disk is unfolded very quickly, as a result of the rotation.

Since the supporting arms and a separate gas generator are no longer required, the brake disk only takes up very little space when in the folded state in the projectile.

BRIEF DESCRIPTION OF THE DRAWINGS

The invention may be better understood by referring to the detailed description of the invention when taken in conjunction with the accompanying drawings in which.

DESCRIPTION OF THE PREFERRED EMBODIMENTS

Figure 1:
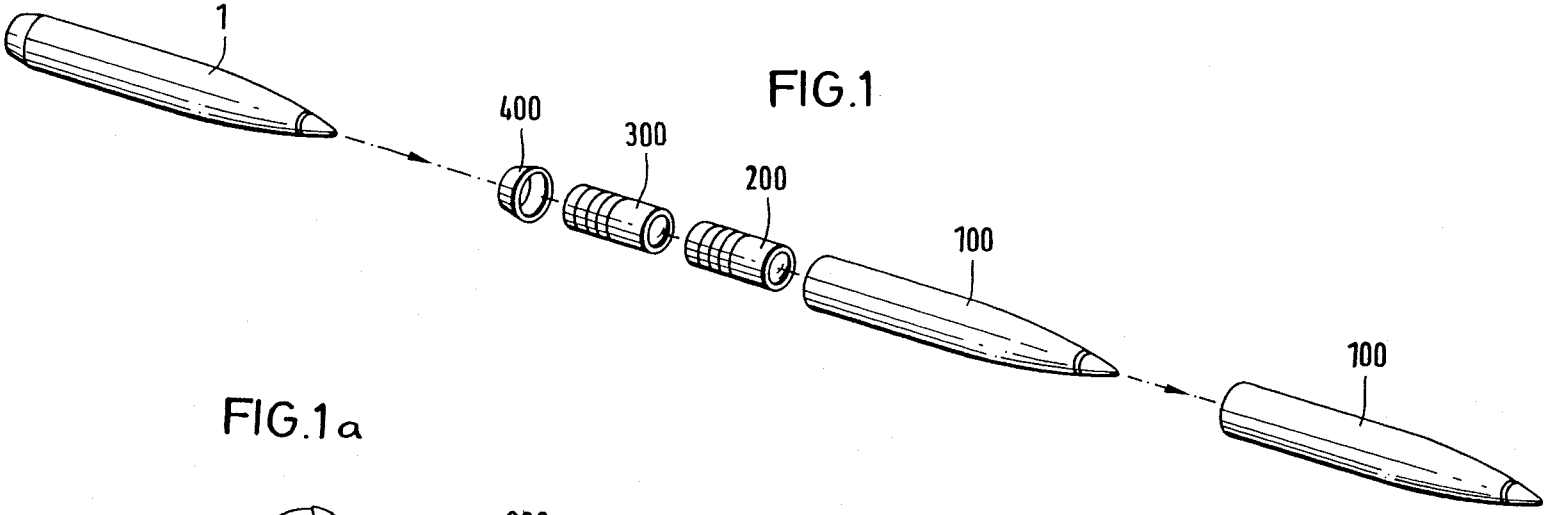
FIG. 1 shows the time sequence of the process of ejecting submunition bodies which are provided with the deceleration elements according to the invention.
Figure 1A:
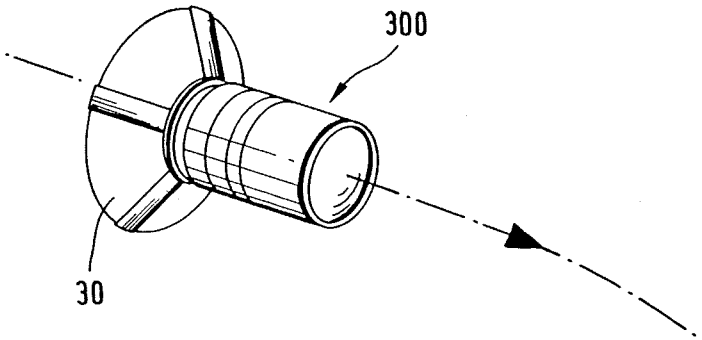
FIG. 1*a* shows a detail of FIG. 1.

FIG. 1 discloses a projectile 1 which has been fired by means of a gun (not shown), for example. This projectile 1 includes a projectile body 100, a projectile bottom 400 and two intelligent submunition bodies 200 and 300 which are ejected from projectile 1 after a predetermined time. The submunition bodies 200, 300 are ejected in a known manner. After this ejection process the projectile body 100, the submunition bodies 200 and 300 and the bottom 400 of projectile 1 initially fly one behind the other. For reasons of clarity, FIG. 1*a* only illustrates a deceleration element 30 for submunition body 300. Unfolding of the deceleration elements 30 causes the velocity of the submunition bodies 200, 300 to be reduced and thus the trajectory of submunition bodies 200, 300 becomes different than the trajectory for projectile body 100 which continues its flight.

Deceleration element 30 produces a reduction in velocity of the submunition body 300, as well as a reduction in spin. As soon as both values have dropped to a predetermined level, the deceleration element 30 is ejected from the submunition bodies 200, 300 (not shown). The submunition bodies 200, 300 may be further decelerated by other means including the unfolding of a parachute, for example and the rotating movement of these bodies can be used to scan the target area (In this connection see Flume "Artilleriemunition: Bessere Wirkung im Ziel" [Artillery Ammunition - Better Effect On Target], in Wehrtechnik [Defense Technology] 1985, No. 10, pages 112 et seq.).

Figure 2:
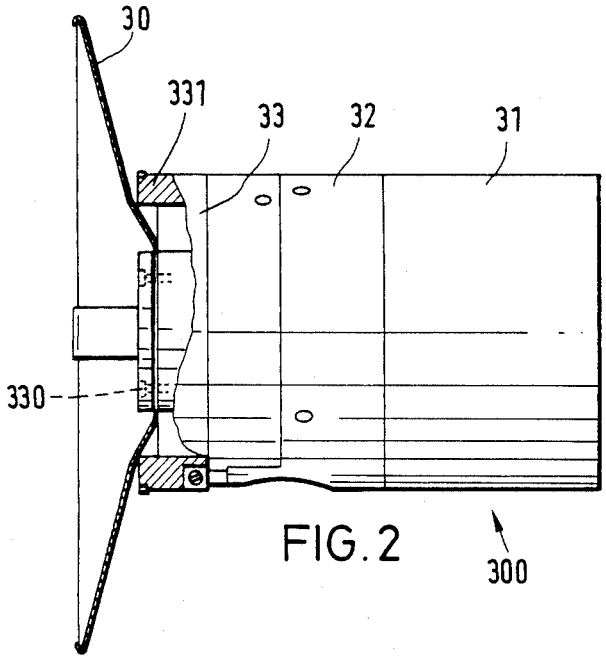
FIG. 2 is a side view and partial sectional view of a submunition body according to FIG. 1 which is equipped with the deceleration element according to the invention.

FIG. 2 is a side view of submunition body 300 during flight with a sectional view in the region of deceleration element or brake disk 30. In addition to deceleration element 30, submunition body 300 includes the actual active body 31 which contains a shaped charge, for example; a housing 32, which may contain signal processing means and a pivotal antenna (not shown); and a removable supporting structure 33 to which brake disk 30 is fastened by securing means, for example, screws 330. An annular projection 331 encloses the packing area for deceleration element 30. As can be seen in FIG. 2, air forces give deceleration element 30 a conical shape. By appropriate measures along the edge of the brake disk 30 or by the particular size of the disk 30 it must be ensured that the forces of the air will not be able to compress the brake disk 30.

Figure 3:
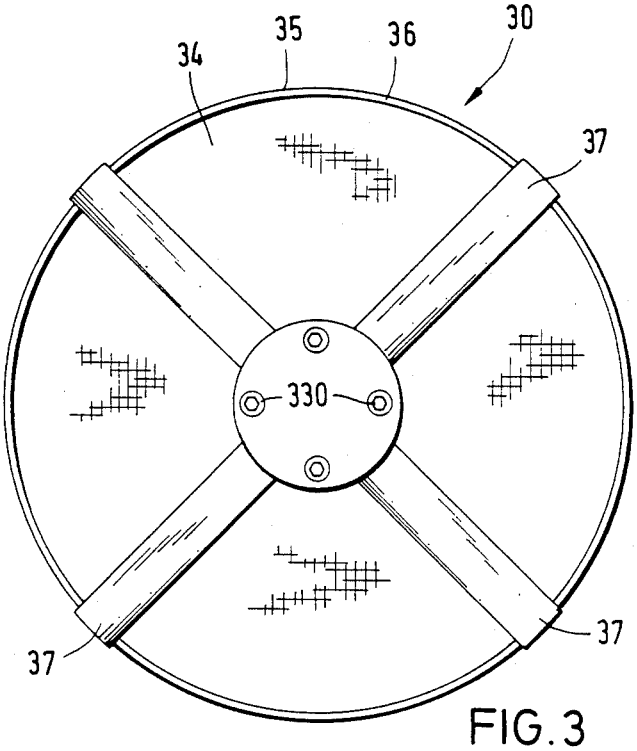
FIG. 3 is a top view of a deceleration element according to the invention as shown in FIG. 2.

FIG. 3 is a plan view from the rear of the brake disk 30 according to the invention as shown in FIG. 2. An edge reinforcement 36 serves the purpose of preventing the edge of the brake disk 30 from tearing as a result of the rapid rotation of submunition body 300. However, the fact that edge reinforcement 36 has a larger mass density in edge region 35 than in the remaining region 34 of the woven brake disk 30 is an even more significant purpose for edge reinforcement 36.

Further stability is imparted to woven brake disk 30 by additional strips of webbing 37. These strips of webbing 37 are preferably arranged in a crosswise pattern. This considerably increases the strength of the entire deceleration element 30. Moreover, additional masses may be applied to the ends of the strips of webbing 37 to ensure fast opening of the brake disk 30. The strips of webbing 37 may also be applied to both sides of the brake disk 30.

A polyamide or a plastic sheet of sufficient strength has been found to be particularly useful as material for the woven brake disk 30 and also for the strips of webbing 37 and the edge reinforcement 36.

Figure 4:
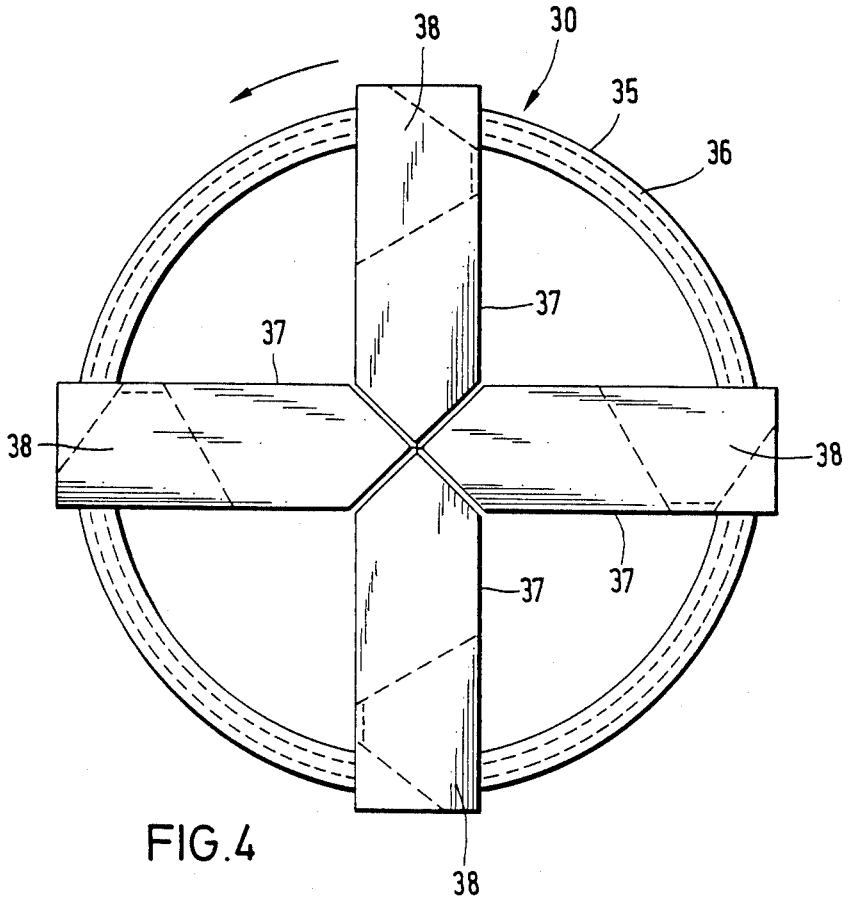
FIG. 4 is a top view of a second embodiment of a deceleration element according to the invention.

FIG. 4 discloses another embodiment which allows submunition body 300 to realize a greater reduction of spin. It has been found advantageous to provide the strips of webbing 37 with pockets 38. The pockets 38 must be arranged in such a manner that they open when the submunition body 300 rotates. The direction of rotation is indicated by an arrow in FIG. 4.

Webbing pockets 38 may either be applied to strips 37 for example by sewing or they may be formed by parts of the strips 37 themselves in the way that the strips 37 are fastened or sewn to the woven brake disk 30.

The present disclosure relates to the subject matter disclosed in German No. P 36 43 294.6-15 of Dec. 18, 1986, the entire Specification of which is incorporated herein by reference It will be understood that the above-description of the present invention is susceptible to various modifications, changes and adaptations, and the same are intended to be comprehended within the meaning and range of equivalents of the appended claims.

What is claimed is:

1. A spin-stabilized projectile comprising:

a projectile body having a rear end; and deceleration means composed of a sheet of material at said rear end, said deceleration means having an edge region and being deployable from a folded condition to an expanded condition with the aid of rotation of said projectile, said deceleration means, when in said expanded condition, having the general form of a disk with a periphery defined by said edge region and being effective for decelerating said projectile, and wherein said deceleration means are constructed such that said edge region has a higher mass density than the remainder thereof.

2. A projectile as defined in claim 1, wherein said sheet of material is composed of a woven fabric.

3. A projectile as defined in claim 1, wherein said sheet of material is composed of plastic sheeting.

4. A projectile as defined in claim 1, wherein said deceleration means further includes an outer edge and an edge reinforcement, and said outer edge is in said edge region and is provided with said edge reinforcement.

5. A projectile as defined in claim 1, wherein said deceleration means comprise strips of webbing for reinforcing said deceleration means.

6. A projectile as defined in claim 5, wherein said strips of webbing include ends located in said edge region and said ends have a mass density substantially equal to that of said edge region of said sheet.

7. A projectile as defined in claim 5, wherein said deceleration means includes two sides with said strips of webbing being disposed on both of said sides.

8. A projectile as defined in claim 5, wherein at least two strips of webbing are crossed on said deceleration means.

9. A projectile as defined in claim 5, wherein said strips of webbing are composed of polyamide.

10. A projectile as defined in claim 5, wherein said deceleration means have an outer edge, and said strips of webbing extend beyond said outer edge of said deceleration means.

11. A projectile as defined in claim 1, wherein said deceleration means has a circular shape.

12. A projectile as defined in claim 1, wherein said sheet of material is composed of polyamide.

13. A spin-stabilized projectile comprising:

a projectile body having a rear end; and deceleration means composed of a sheet of material at said rear end, said deceleration means having an edge region and being deployable from a folded condition to an expanded condition with the aid of rotation of said projectile, said deceleration means, when in said expanded condition, having the general form of a disk with a periphery defined by said edge region and being effective for decelerating said projectile, said deceleration means being constructed such that said edge region has a higher mass density than the remainder thereof, said deceleration means including strips of webbing for reinforcing said deceleration means and said strips of webbing having pocket-shaped recesses which open during rotation of said projectile, whereby the open recesses cause an additional reduction in the spin of said projectile.

* * * * *